US010816165B2

(12) United States Patent
McCracken, Jr. et al.

(10) Patent No.: US 10,816,165 B2
(45) Date of Patent: Oct. 27, 2020

(54) LED LUMINAIRE ASSEMBLY

(71) Applicant: LSI Industries Inc., Cincinnati, OH (US)

(72) Inventors: Edward R. McCracken, Jr., Cincinnati, OH (US); John D. Boyer, Lebanon, OH (US); James G. Vanden Eynden, Hamilton, OH (US); Eric J. Mooar, Liberty Township, OH (US)

(73) Assignee: LSI Industries, Inc., Cincinnati, OH (US)

( * ) Notice: Subject to any disclaimer, the term of this patent is extended or adjusted under 35 U.S.C. 154(b) by 0 days.

(21) Appl. No.: 15/164,301

(22) Filed: May 25, 2016

(65) Prior Publication Data

US 2017/0146217 A1 May 25, 2017

Related U.S. Application Data

(60) Provisional application No. 62/257,365, filed on Nov. 19, 2015.

(51) Int. Cl.
*F21V 1/00* (2006.01)
*F21V 13/04* (2006.01)
(Continued)

(52) U.S. Cl.
CPC ..... *F21V 13/04* (2013.01); *F21V 5/007* (2013.01); *F21V 17/005* (2013.01);
(Continued)

(58) Field of Classification Search
CPC ... F21V 5/007; F21V 13/04; F21W 2131/103; F21W 2131/107; F21Y 2105/00; F21Y 2105/10; F21Y 2105/16
(Continued)

(56) References Cited

U.S. PATENT DOCUMENTS 3,610,915 A * 10/1971 Moore ..... F21S 8/081 362/282
4,078,351 A * 3/1978 Simpson ..... E04B 7/105 52/536
(Continued)

OTHER PUBLICATIONS

Simtec, Optical Liquid Silicone Rubber, https://www.simtec-silicone.com/optical-liquid-silicone-rubber/, Jul. 25, 2018 (Year: 2018).*
(Continued)

*Primary Examiner* — Matthew J. Peerce
(74) *Attorney, Agent, or Firm* — Wood Herron & Evans LLP

(57) ABSTRACT

A luminaire assembly and a silicone optical array. The luminaire assembly includes a housing, a substrate, and a silicone optical array. The housing defines a light emitting chamber. The substrate has a plurality of light emitting sources, such as light emitting diodes, supported thereby in an array. The substrate defines a peripheral edge. The silicone optical array has a plurality of silicone optics formed in the silicone optical array. The silicone optical array is located so as to cover one side of the substrate and the plurality of light emitting sources. The silicone optical array may further include a silicone mat and a plurality of silicone optics formed in the silicone mat and being arranged in an array corresponding to the array of light emitting sources.

21 Claims, 12 Drawing Sheets

(51) Int. Cl.

| | |
|---|---|
| ***F21V 5/00*** | (2018.01) |
| ***F21V 31/00*** | (2006.01) |
| ***F21V 23/00*** | (2015.01) |
| ***F21V 17/00*** | (2006.01) |
| *F21Y 105/16* | (2016.01) |
| *F21Y 115/10* | (2016.01) |
| *F21W 131/103* | (2006.01) |
| *F21V 7/04* | (2006.01) |
| *F21S 8/08* | (2006.01) |

(52) U.S. Cl.
CPC ..... *F21V 23/002* (2013.01); *F21V 31/005* (2013.01); *F21S 8/086* (2013.01); *F21V 7/04* (2013.01); *F21W 2131/103* (2013.01); *F21Y 2105/16* (2016.08); *F21Y 2115/10* (2016.08)

(58) Field of Classification Search
USPC ..... 362/235, 244, 245
See application file for complete search history.

(56) References Cited

U.S. PATENT DOCUMENTS

| | | | | |
|---|---|---|---|---|
| 5,630,304 | A * | 5/1997 | Austin | E04F 15/10 428/57 |
| 6,042,139 | A * | 3/2000 | Knox | B29C 45/14336 280/728.3 |
| 10,081,952 | B2 * | 9/2018 | Bowers | A63B 6/00 |
| 2008/0084693 | A1 | 4/2008 | Shimada et al. | |
| 2008/0112165 | A1 | 5/2008 | Mori et al. | |
| 2011/0031516 | A1 | 2/2011 | Basin et al. | |
| 2011/0075421 | A1 * | 3/2011 | Lai | F21K 9/00 362/249.01 |
| 2011/0114977 | A1 | 5/2011 | Miura | |
| 2011/0280014 | A1 * | 11/2011 | Householder | G02B 5/005 362/235 |
| 2012/0188766 | A1 * | 7/2012 | Lu | F21V 29/763 362/249.02 |
| 2012/0230033 | A1 | 9/2012 | Yoon et al. | |
| 2012/0287649 | A1 | 11/2012 | Kelley | |
| 2012/0307504 | A1 | 12/2012 | Chou | |
| 2013/0107528 | A1 | 5/2013 | Boyer et al. | |
| 2013/0301264 | A1 * | 11/2013 | Van Gompel | F21S 2/005 362/236 |
| 2014/0168975 | A1 * | 6/2014 | Ng | F21V 5/007 362/244 |
| 2015/0124449 | A1 * | 5/2015 | Wilcox | F21K 9/50 362/244 |
| 2015/0204491 | A1 * | 7/2015 | Yuan | F21V 5/045 362/311.02 |
| 2015/0260376 | A1 * | 9/2015 | Joo | F21V 5/007 362/235 |
| 2016/0215955 | A1 * | 7/2016 | Donato | F21V 23/005 |
| 2016/0320046 | A1 * | 11/2016 | Duckworth | F21V 29/74 |
| 2017/0038056 | A1 * | 2/2017 | Joiris | F21K 9/20 |
| 2018/0017235 | A1 * | 1/2018 | Casper | F21V 31/005 |

OTHER PUBLICATIONS

Dow Corning Corporation, Form No. 11-3371a-01 Insert M, "Modular Optics", 2013, 2 pages.
Dow Corning Corporation, Form No. Nov. 3371-01 Insert K, "Moldable Silicones for Secondary Optics Applications", 2013, 27 pages.

* cited by examiner

LED LUMINAIRE ASSEMBLY

CROSS-REFERENCE TO RELATED APPLICATION

The present application claims the filing benefit of U.S. Provisional Application Ser. No. 62/257,365, filed Nov. 19, 2015, the disclosure of which is incorporated herein by reference in its entirety.

FIELD OF THE INVENTION

The present invention relates generally to a luminaire assembly for casting light to illuminate an area and, more particularly, to a luminaire assembly that includes a plurality of light emitting diodes for generating the desired illumination pattern.

BACKGROUND OF THE INVENTION

In the past, luminaire assemblies have been designed to include a plurality of light emitting diodes ("LEDs") for generating a desired illumination pattern on a surface. Typically, the LEDs are mounted on a printed circuit board in an array, with the LEDs being covered by a single optic that comprises at least a refractor, and also possibly a reflector, through which the light from the LEDs is emitted. In this style of luminaire assembly, the single optic may be made of silicone or, alternatively, a polycarbonate or acrylic-based material.

In an alternative style of luminaire assembly, the plurality of LEDs are covered by an optical array, wherein each LED is associated with a single optic. So, in this style of luminaire assembly, the optical array is provided with a plurality of optics, with each LED being associated with one of the plurality of optics.

However, in this style of luminaire assembly, the optical array is typically made of a polycarbonate or acrylic-based material to reduce expansion and contraction of the individual optics due to thermal cycling since these materials have a generally low coefficient of linear expansion. In this way, the polycarbonate or acrylic-based optics do not sufficiently deform as a result of thermal cycling so the optics are generally able to provide generally uniform light transmission through the respective walls of the individual optics.

Silicone material, on the other hand, has a generally high coefficient of linear expansion so its use in optics has been generally limited to a single optic for covering a plurality of LEDs since the size of the silicone optic in this configuration lends itself better for control of its shape during thermal cycling.

While polycarbonate or acrylic-based optics are less susceptible to expansion and contraction due to thermal cycling, forming optical arrays made of these materials is generally more expensive and costly than forming an optic of silicone. Moreover, polycarbonate and acrylic-based optics are more susceptible to damage over time due to age and the adverse effects of thermal cycling, weather and other factors acting upon the optics.

Thus, there is a need for a luminaire assembly having an improved optical array that effectively controls expansion and contraction of the optics due to thermal cycling and other factors while eliminating the problems associated with using polycarbonate and acrylic-based optics.

SUMMARY OF THE INVENTION

The present invention overcomes the foregoing and other shortcomings and drawbacks of luminaire assemblies and silicone optical arrays heretofore known for use in lighting applications. While the invention will be described in connection with certain embodiments, it will be understood that the invention is not limited to these embodiments. On the contrary, the invention includes all alternatives, modifications and equivalents as may be included within the spirit and scope of the present invention.

In accordance with the principles of the present invention, a silicone optical array for use with a luminaire assembly having a plurality of light emitting sources arranged in an array is shown and described. The silicone optical array includes a silicone mat and a plurality of silicone optics formed in the silicone mat that are arranged in an array corresponding to the array of light emitting sources.

Each silicone optic may include a refractor and a reflector formed in the silicone mat.

In one embodiment, one or more silicone pegs are formed on an underside of the silicone mat and are configured to secure the silicone mat to a substrate, such as a printed circuit board ("PCB"), supporting the array of light emitting sources. In other embodiments, at least one of the silicone pegs has a head portion that is configured to contact an underside of the substrate supporting the array of light emitting sources. In another embodiment, the silicone mat is configured to wrap around the peripheral edge of the substrate and may contact opposing sides of the substrate further securing the silicone mat to the substrate.

According to any embodiment, the silicone mat includes at least first and second silicone mat sections interlocked together, wherein one of the first or second silicone mat sections has a locking portion that is configured to couple with a receiving portion of the other of the first or second silicone mat sections. The locking portion and the receiving portion may be provided adjacent at least one peripheral edge of the respective first or second silicone mat sections.

A sealing bead may be formed on the silicone mat adjacent at least one peripheral edge thereof to provide a hermetic seal between the silicone mat and the substrate. The light emitting sources supported by the substrate may be light emitting diodes.

According to another aspect of the present invention, a luminaire assembly includes a housing, a substrate, and a silicone optical array. The housing defines a light emitting chamber. The substrate has a plurality of light emitting sources supported thereby in an array. The substrate also defines a peripheral edge. The silicone optical array has a plurality of silicone optics formed in the silicone optical array. The silicone optical array being located so as to cover at least a first side of the substrate and the plurality of light emitting sources.

In some embodiments, the housing includes an electrical component chamber separated by a wall from the light emitting chamber and an air vent wireway extending through the wall and fluidly communicating with the light emitting chamber and the electrical component chamber. The air vent wireway is configured to prevent an accumulation of air pressure in the light emitting chamber due to thermal cycling.

In some embodiments, the luminaire assembly includes an optical frame including a plurality of fingers for securing the silicone optical array against the substrate. The optical frame further includes a plurality of windows located respectively between the plurality of fingers that are configured to allow light emitted from the light emitting sources to emanate therethrough.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

Figure 1:
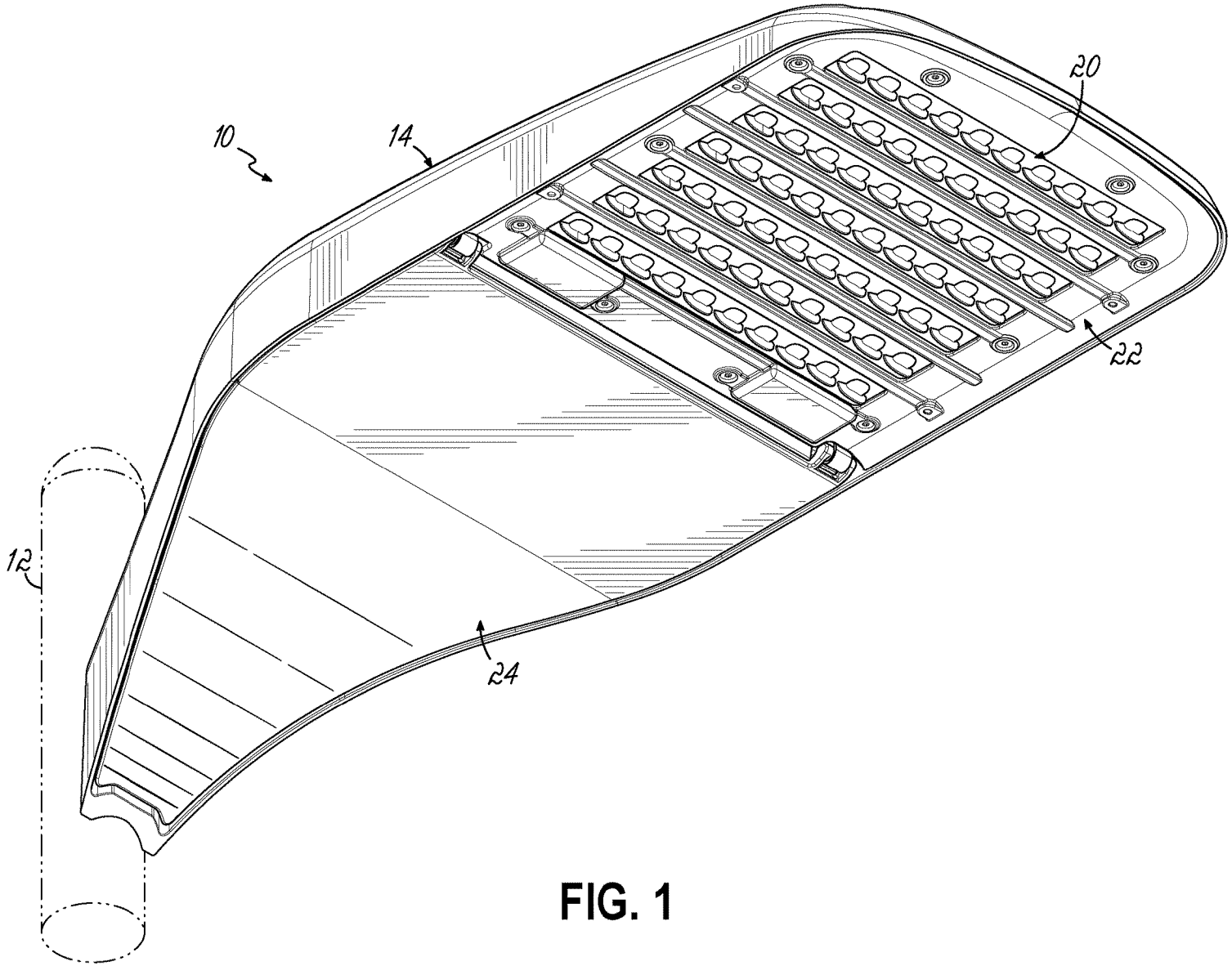
FIG. 1 is a perspective view of a luminaire assembly according to an exemplary embodiment of the present invention in an assembled state.
Figure 2:
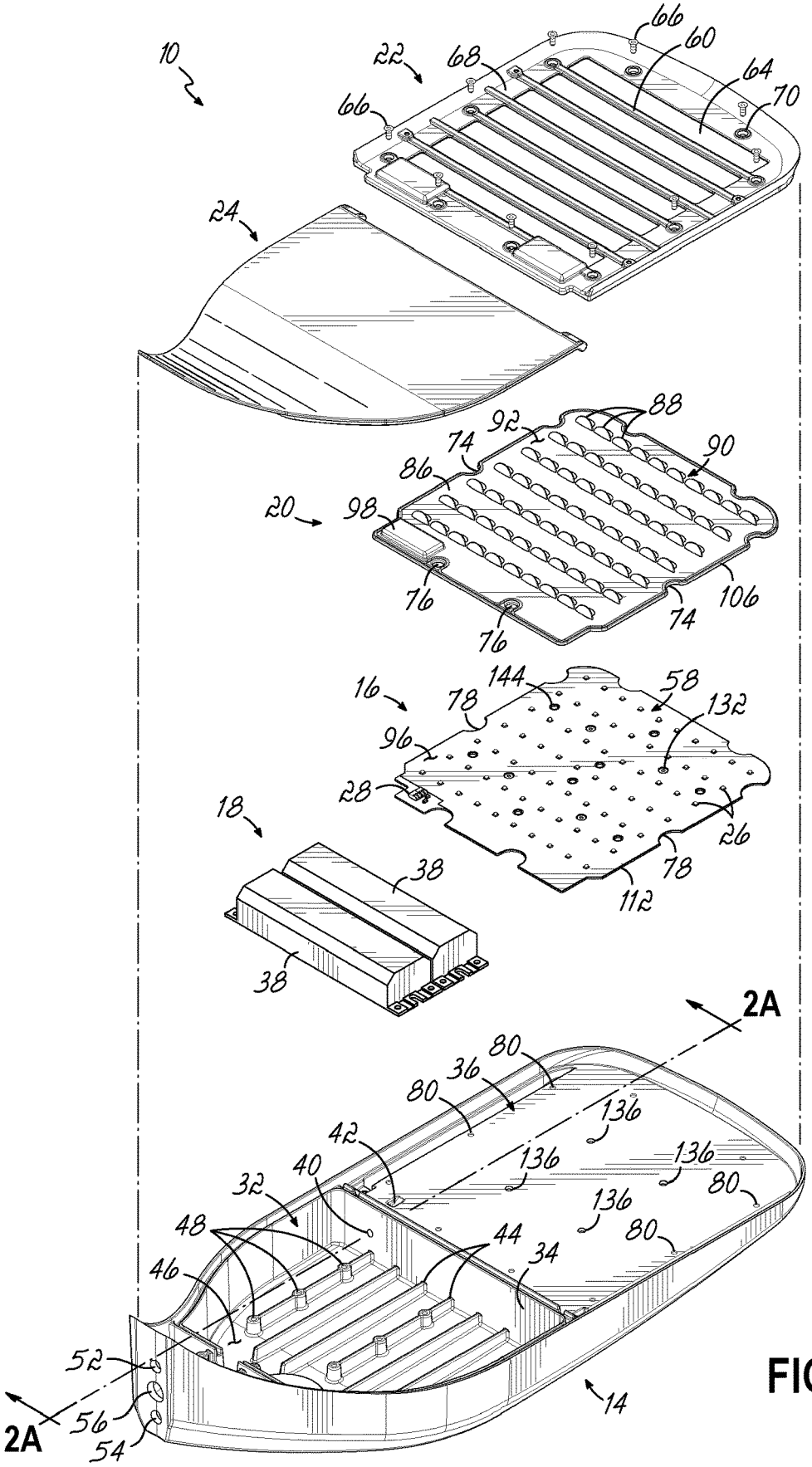
FIG. 2 is an exploded view of the luminaire assembly of FIG. 1, including a housing, a substrate supporting a plurality of light emitting diodes ("LEDs"), a silicone optical array, and an optical frame.

Referring now to the figures, and to FIGS. 1 and 2 in particular, a luminaire assembly 10 is shown according to an exemplary embodiment of the present invention. While the luminaire assembly 10 shown in FIG. 1 is generally applicable to any application that would benefit from indoor or outdoor area lighting, it is well-suited, in one example, for application to street, parking lot, and garage lighting. For example, FIG. 1 shows the luminaire assembly 10 in an assembled state mounted to a pole 12. Other applications are contemplated, such as mounting the luminaire assembly 10, for example, to a wall of a building (not shown). The luminaire assembly 10 may also be hung from a ceiling facing downward or facing upward to cast light toward the ceiling if desired.

Further, the luminaire assembly 10 can be used for a new installation or to replace an existing fixture. The luminaire assembly 10 can reduce energy consumption, maintenance, installation time and overall cost when compared to existing techniques and lighting devices. The versatility of the luminaire assembly 10 also provides benefits to manufacturers, installers, and end-users of such luminaire assemblies 10 through lower manufacturing and inventory costs as well as the ability of the end-user to upgrade, adapt, or fix the luminaire assembly 10 in the field.

FIG. 2 shows an exploded view of FIG. 1, where the luminaire assembly 10 is positioned upside down to better visualize the various components. As shown, the luminaire assembly 10 generally includes a housing 14, a substrate 16, electrical components 18, a silicone optical array 20, an optical frame 22, and a cover 24.

Figure 5:
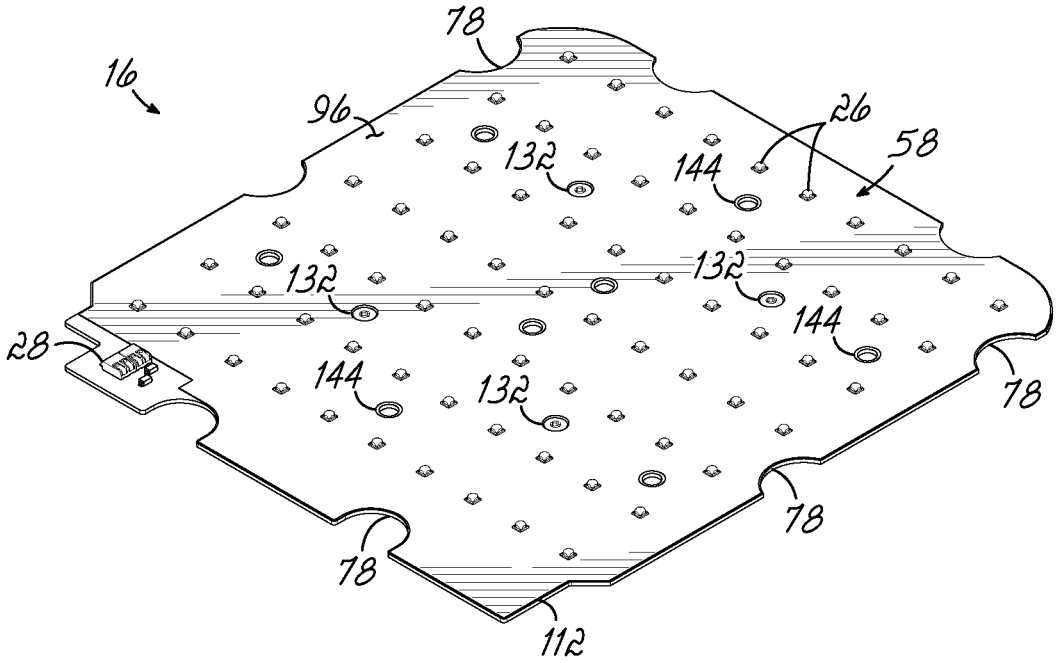
FIG. 5 is an enlarged perspective view of the substrate of FIG. 2.

The substrate 16 shown in FIG. 2, which is enlarged in FIG. 5, may comprise a printed circuit board ("PCB"). The substrate 16 supports and electrically connects a plurality of light emitting sources supported thereby in an array, collectively referred to as an "array of light emitting sources" to a source of power. While the light emitting sources are shown and described herein as light emitting diodes 26 ("LEDs"), other light emitting sources may be used in addition to, or instead of LEDs 26, within the scope of the present disclosure. By way of example only, other light sources such as plasma light sources may be used. As used herein, the term "LEDs" is intended to include all types of light emitting diodes 26 including organic light emitting diodes ("OLEDs"), and LEDs that generate different colors of light.

With continued reference to FIG. 2, the housing 14, which may be made of aluminum, stainless steel, or other suitable materials, includes an electrical component chamber 32 that is separated by a wall 34 from a light emitting chamber 36. As shown, the wall 34 may be integrally formed with the housing 14. Further, according to one embodiment, the electrical component chamber 32 may be hermetically or non-hermetically sealed, while the light emitting chamber 36 may be hermetically sealed. In one embodiment, the electrical components 18 may comprise ballasts 38 and other components known by those skilled in the art to operate a luminaire assembly 10 of the type described herein. Ribs 44 are constructed on an interior surface 46 of the electrical component chamber 32. The ribs 44 include apertures 48 to receive fasteners (not shown) to secure the various electrical components 18 (such as the ballasts 38) to the housing 14. The housing 14 also includes first and second apertures 52, 54 that are provided for mounting the housing 14 onto the pole 12 (shown in FIG. 1) through suitable fasteners (not shown). A third aperture 56 is provided for routing electrical wires to the luminaire assembly 10 from the pole 12.

Figure 2A:
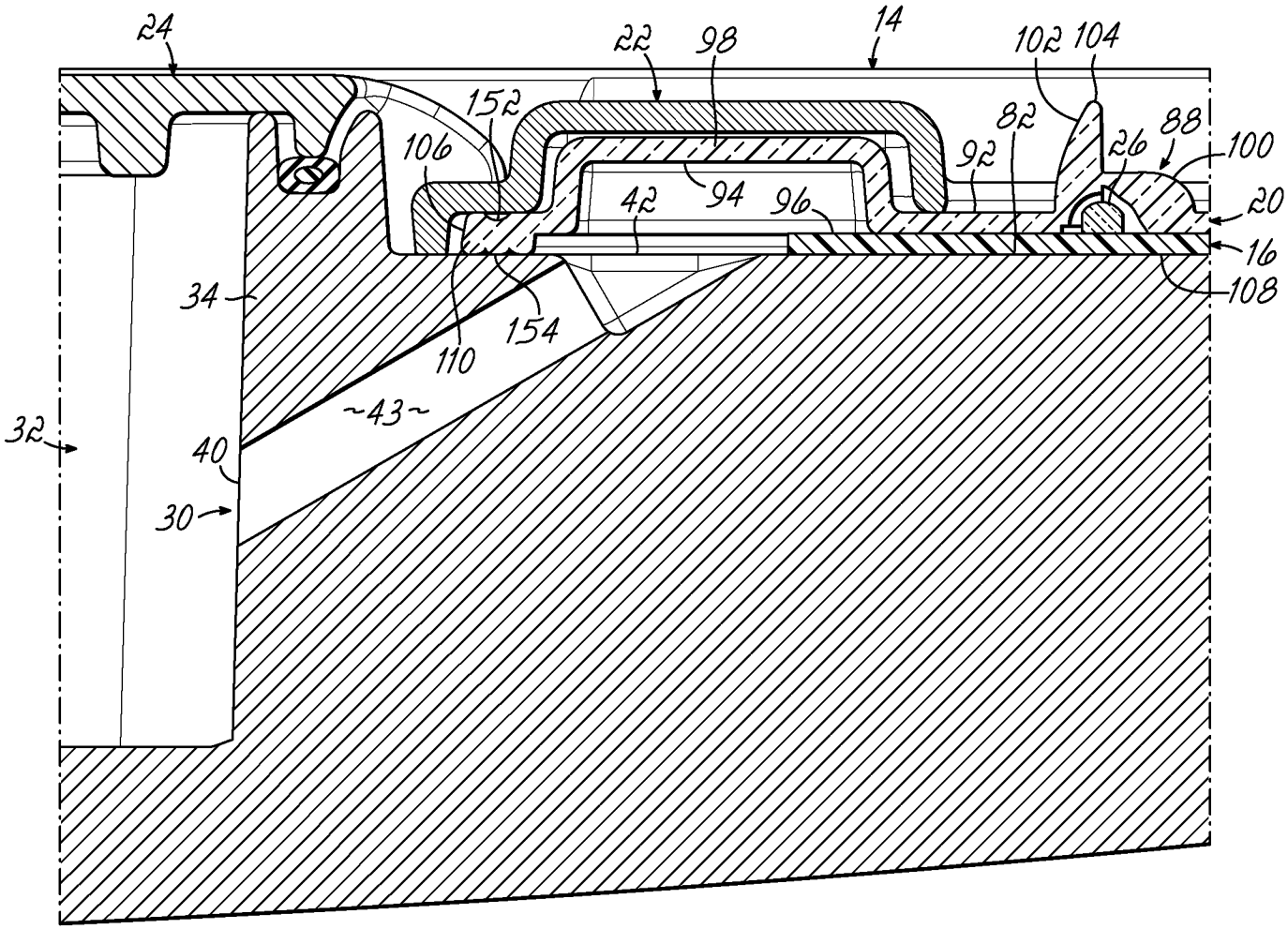
FIG. 2A shows a cross-sectional view of the air vent wireway according to an embodiment of the present invention.

With continued reference to FIG. 2, and specifically to FIG. 2A, the housing 14 includes an air vent wireway 30 extending through the wall 34 and fluidly communicating the electrical component chamber 32 with the light emitting chamber 36. As shown, the air vent wireway 30 includes a first opening 40 located on the wall 34, a second opening 42 located on an interior surface 82 of the light emitting chamber 36, and a channel 43 extending therebetween. The air vent wireway 30 permits routing of electrical wires (not shown) from the electrical component chamber 32 to the light emitting chamber 36 where the wires (not shown) may be connected to one or more connectors 28 provided on the substrate 16 to provide power to the LEDs 26. According to one aspect of the present invention, the air vent wireway 30 is unsealed around the electrical wires (not shown) routed through the air vent wireway 30 so as to reduce or prevent an accumulation of air pressure within the light emitting chamber 36 due to thermal cycling of the array of LEDs 58. As air pressure builds up between the first surface 96 of the substrate 16 and the second surface 94 of the silicone optical array 20 due to heat produced from the array of LEDs 58, that air pressure is relieved by the air vent wireway 30 as air travels from the light emitting chamber 36 through the air vent wireway, and to the electrical component chamber 32. The air vent wireway 30 allows the silicone optical array 20 to breathe by releasing this excess pressure without the need of additional components, such as, for example, breather tubes or breather patches which would add additional cost and complexity to the luminaire assembly 10.

Figure 3:
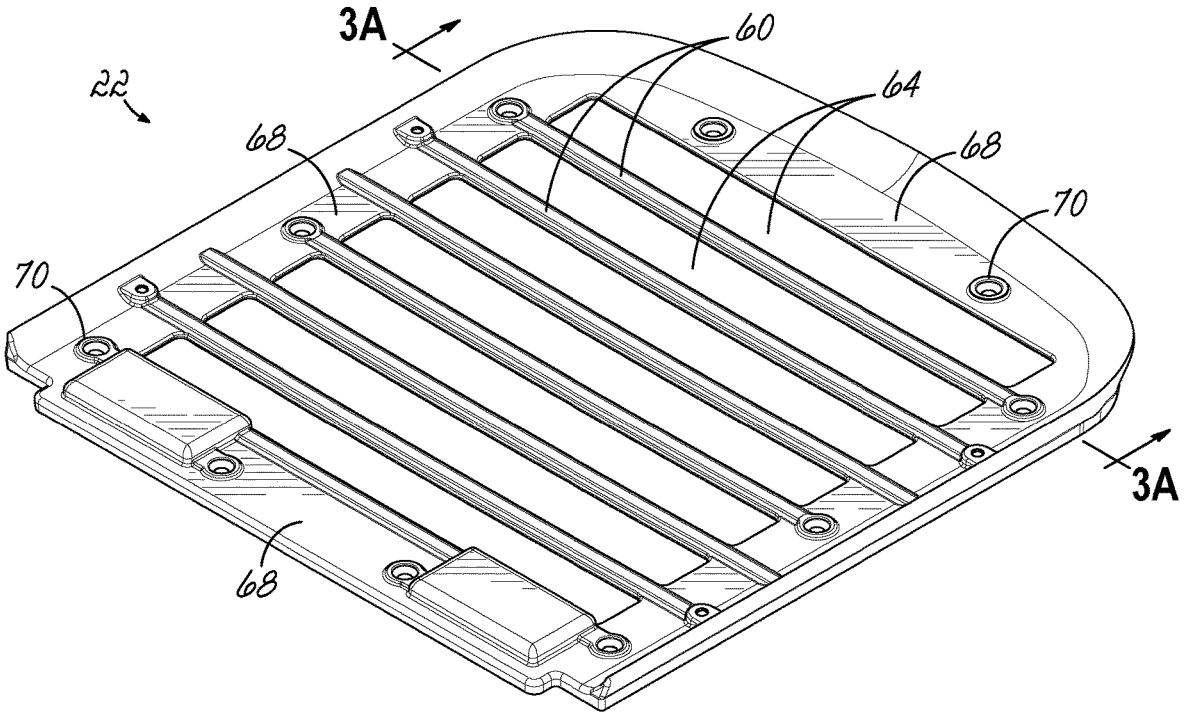
FIG. 3 is an enlarged perspective view of the optical frame shown in FIG. 2.
Figure 3A:
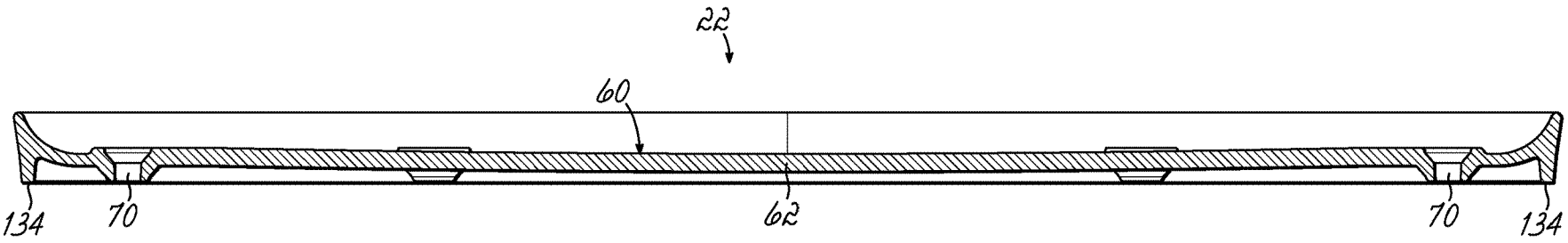
FIG. 3A is front cross-sectional view of the optical frame taken along line 3A-3A of FIG. 3.

As shown in FIGS. 2 and 3, the optical frame 22 includes fingers 60 to prevent the silicone optical array 20 from moving relative to the substrate 16. In the embodiment shown, the fingers 60 generally extend parallel one another. However, it is also envisioned that the fingers 60 may extend in other manners to secure the silicone optical array 20 against the substrate 16 containing the array of LEDs 58. Advantageously, as shown in the front cross-sectional view of FIG. 3A, the fingers 60 have a curved center portion 62 that curves inwardly toward the center of silicone optical array 20. The curved center portion 62 provides sufficient clamping force to the center region of the silicone optical array 20, without the need for additional fasteners within the center of the silicone optical array 20.

As shown in FIGS. 2 and 3, a plurality of windows 64 are located between the fingers 60 and between the perimeter portion 68 of the optical frame 22. In one embodiment, the windows 64 comprise voids that allow light emitted from the LEDs 26 to pass through to the areas intended to be illuminated. In one exemplary embodiment, the optical frame 22 is constructed from aluminum using a die cast manufacturing process. One skilled in the art would appreciate that other materials and other manufacturing processes may be suitably utilized.

As shown in FIG. 2, to assemble the luminaire assembly 10, fasteners 66 are inserted into the apertures 70 located along the perimeter portion 68 of the optical frame 22. The fasteners 66 extend through cutouts 74 and apertures 76 formed in the silicone optical array 20. Likewise, the fasteners 66 extend through cutouts 78 formed in the substrate 16. The fasteners 66 are received in apertures 80 located on an interior surface 82 of the light emitting chamber 36 of the housing 14. In one embodiment, the cover 24 may be pivotably connected to the housing 14, allowing access to the electrical component chamber 32, with the cover 24 being fastened to the housing 14 via one or more suitable fasteners (not shown). The assembly of the housing 14, the substrate 16, the silicone optical array 20, and the optical frame 22 will be further described in detail below with reference to FIG. 7.

Figure 4:
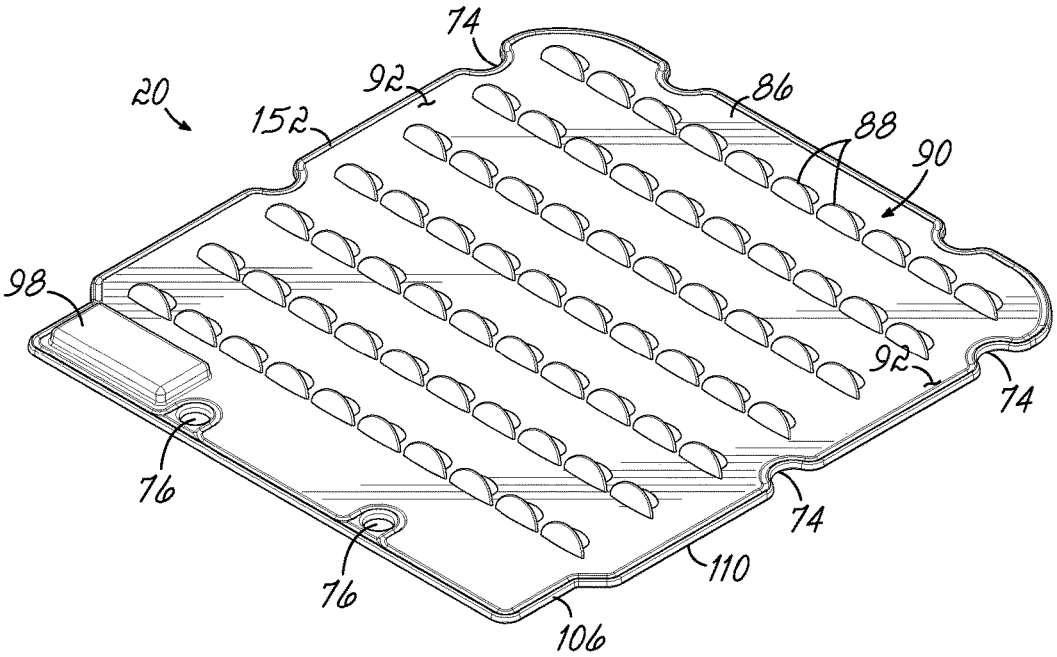
FIG. 4 is an enlarged perspective view of the silicone optical array shown in FIG. 2.

The silicone optical array 20 shown in FIG. 2, which is enlarged in FIG. 4, comprises a silicone mat 86 and a plurality of individual silicone optics 88 formed in the silicone mat 86. The individual silicone optics 88 collectively form an array of silicone optics 90 corresponding to the array of LEDs 58 in a 1:1 relationship of individual silicone optics 88 to individual LEDs 26. While a 1:1 relationship between the individual silicone optics 88 and the individual LEDs 26 is shown, other relationships may alternatively be used (for example a 1:2 relationship between the individual silicone optics 88 and the individual LEDs 26 or a relationship where one or more of the individual LEDs 26 do not include a corresponding individual silicone optic 88). As shown, the array of silicone optics 90 is ten silicone optics 88 wide by seven silicone optics 88 deep (10×7 array). Likewise, seventy individual LEDs 26 collectively form the 10×7 array of LEDs 58 shown in FIG. 5. One of ordinary skill in the art would appreciate that other array sizes and array configurations for both the array of silicone optics 90 and array of LEDs 58 are also envisioned.

Figure 7:
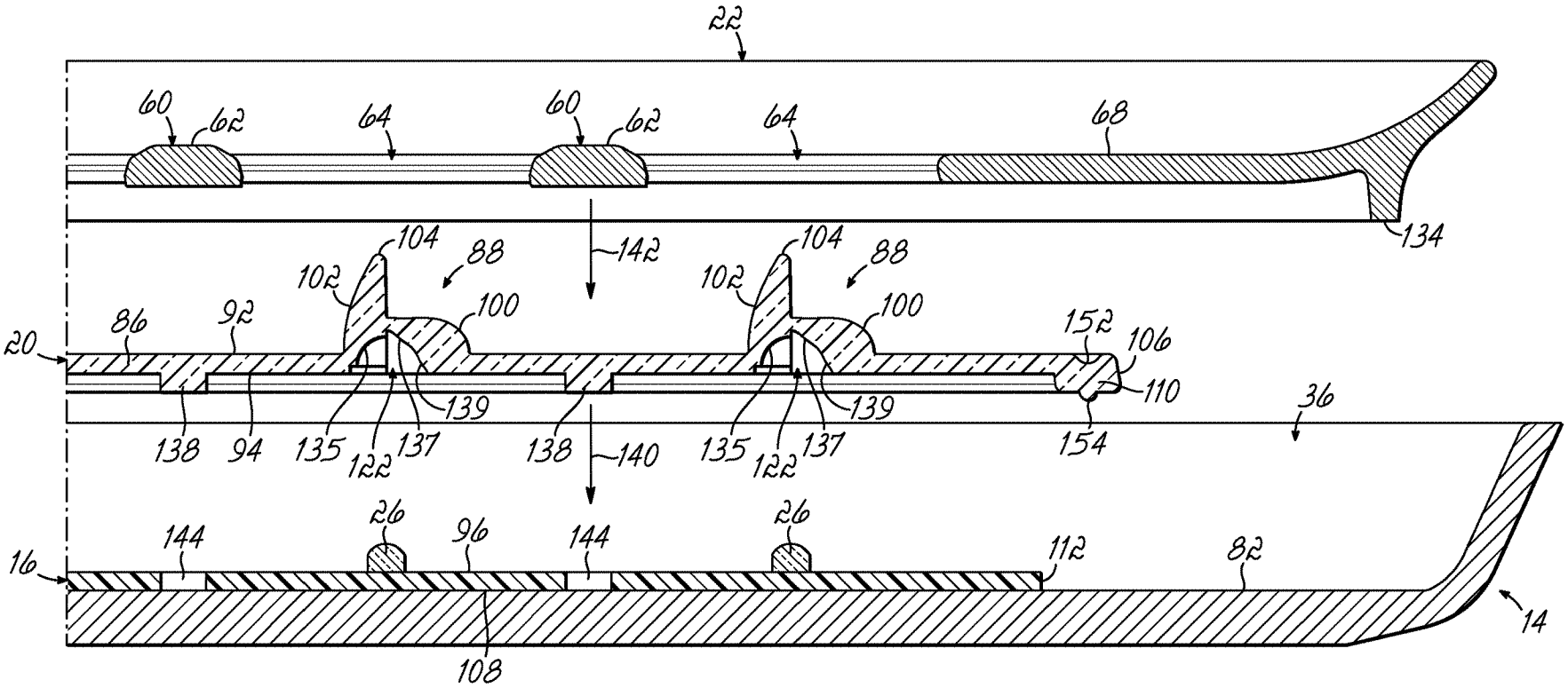
FIG. 7 is a schematic side cross-sectional view of the luminaire assembly in a yet to be assembled state according to another embodiment of the present invention.

The silicone mat 86 includes a first side 92 (shown in FIGS. 2 and 4) and a second side 94 (shown in FIG. 4E), also known as the underside 94. The second side 94 of the silicone mat 86 covers the first side 96 of the substrate 16 (the second side 108 of the substrate 16 is shown in FIG. 7). The silicone optical array 20 provides optical control to the LEDs 26 creating optimal optical distributions, while simultaneously sealing the substrate 16 from the environment. As shown, the silicone mat 86 includes a raised portion 98 that is configured to receive the connector 28.

Figure 4A:
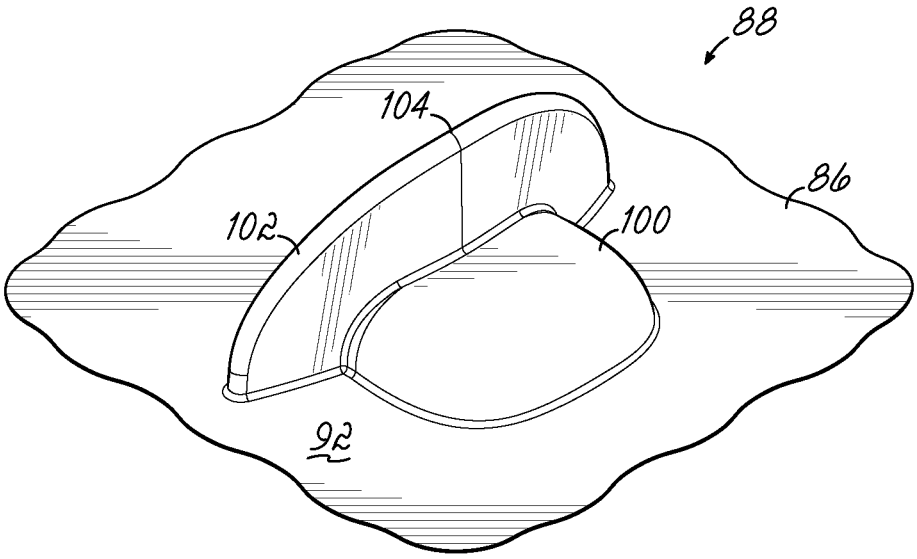
FIGS. 4A and 4B are detail views of an individual optic as shown in FIG. 4 from different angles.
Figure 4B:
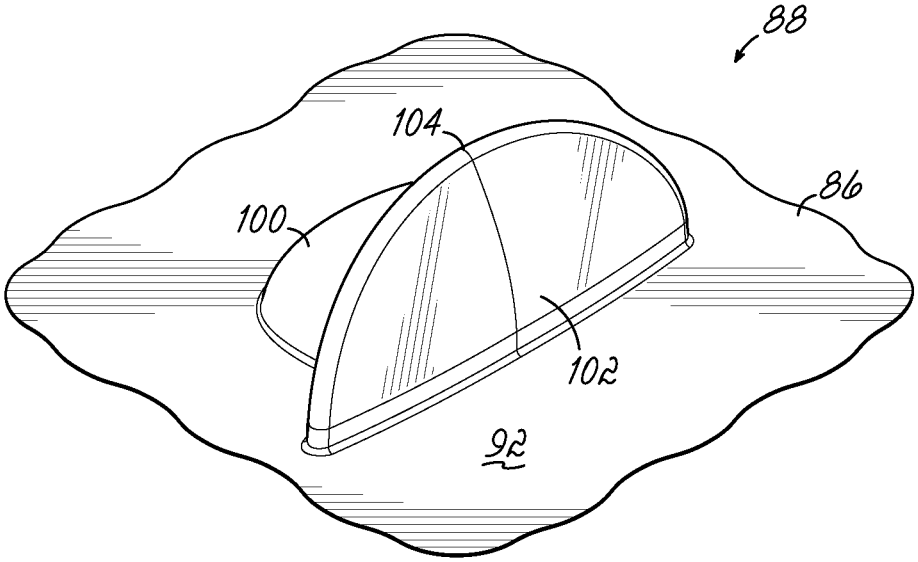

FIGS. 4A and 4B are detail views of a single silicone optic 88 shown in FIG. 4. Each silicone optic 88 includes a silicone refractor 100 and a silicone reflector 102 formed on the first side 92 of the silicone mat 86. As shown in FIGS. 4A and 4B, the silicone refractor 100 is shaped as a quarter ellipsoid, while the silicone reflector 102 is shaped as a disc that is angled toward the silicone refractor 100 at the top 104 to maximize the efficiency of the LED 26 (not shown in FIGS. 4A and 4B).

Figure 4C:
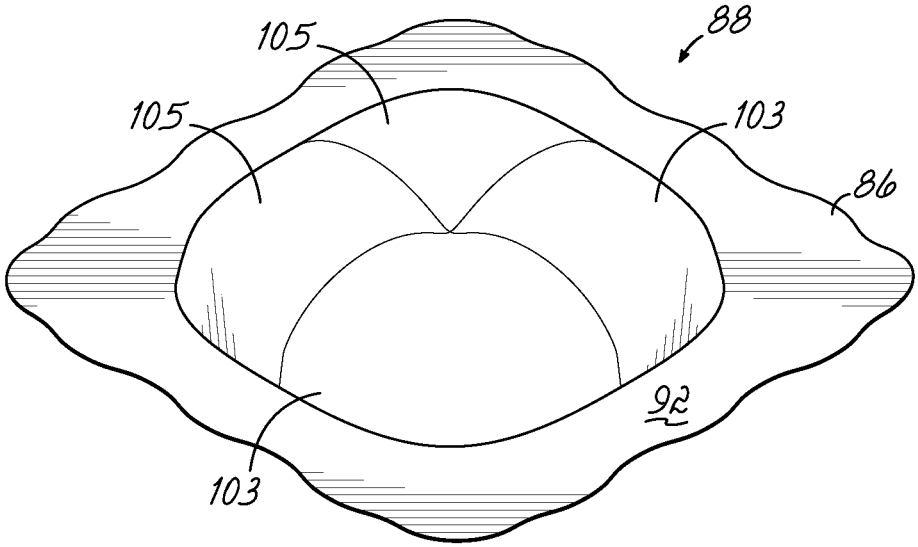
FIG. 4C is a detail view of an individual optic according to another embodiment of the present invention.

According to another embodiment of the present invention, FIG. 4C shows that the silicone optic 88 may include a front refractor portion 103 and a rear refractor portion 105, with the rear refractor portion 105 being a mirror image of the front refractor portion 103. In this embodiment, a silicone reflector 100 as shown in FIGS. 4A and 4B is not provided with the silicone optic 88. Alternatively, the silicone optics 88 forming the silicone mat sections 116 of FIGS. 4D and 6 have silicone refractors 100 constructed as hemispheres without silicone reflectors. One skilled in the art would appreciate that other three-dimensional convex shapes and sizes are also envisioned.

Figure 4D:
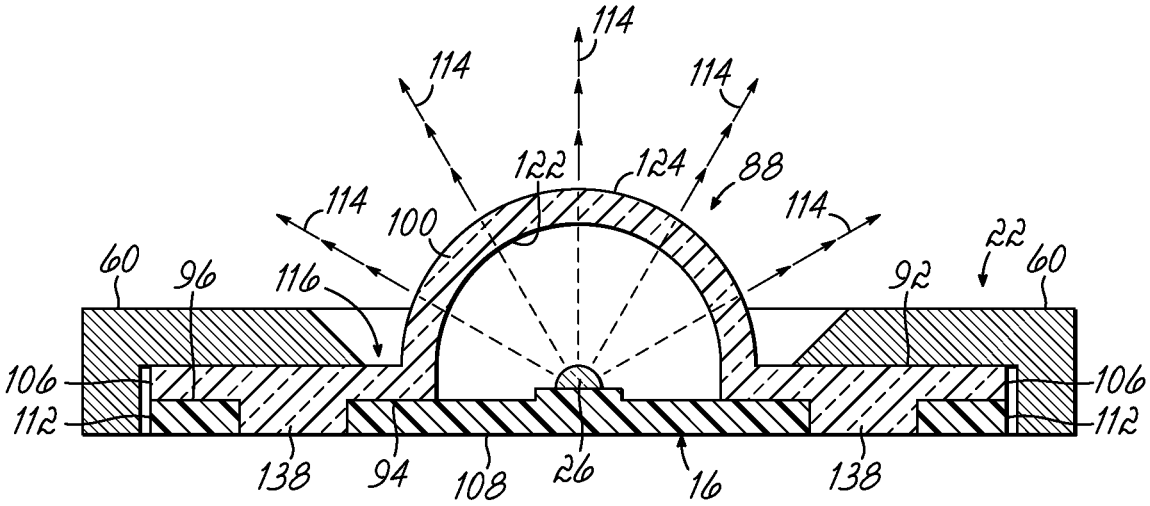
FIG. 4D is a diagrammatic cross-sectional view of an individual optic according to another embodiment of the present invention.

According to another aspect of the present invention, FIG. 4D is a diagrammatic view of a silicone optic 88, wherein each silicone optic 88 is secured around each light center (shown as an LED 26) by the optical frame 22 using fingers 60 and silicone pegs 138. The fingers 60 in this embodiment, extend along the peripheral edge 106 of the silicone optical array 20 and the peripheral edge 112 of the substrate 16. The silicone pegs 138 formed on the second side 94 of the silicone mat 86 secure the silicone optic 88 to the substrate 16 containing the array of LEDs 58 which is described in greater detail in relation to FIGS. 7, 7A, and 7B. Securing the silicone optic 88 about the individual LED 26, allows the silicone refractor 100 of the silicone optic 88 to expand radially outward (as shown by arrows 114) uniformly in relation to the LED 26 supported on the substrate 16 in optically preferred directions. This preserves the optical performance of the LED 26 in all thermal conditions (even at elevated temperatures) as the silicone optic 88 is generally sufficiently constrained to expand radially outwardly in a uniform manner.

With continued reference to FIG. 4D, the silicone refractor 100 includes an inner surface 122 that faces the LED 26 and an outer surface 124. As shown, the inner and outer surfaces 122, 124 are shaped as hemispheres, with a generally uniform layer of silicone separating the inner and outer surfaces 122, 124. One skilled in the art would appreciate, that the thickness of the silicone between the inner and outer surfaces 122, 124 may vary to control the expansion and contraction of the silicone refractor 100. This allows for generally uniform expansion of the silicone refractor 100 around the LED 26.

Figure 4E:
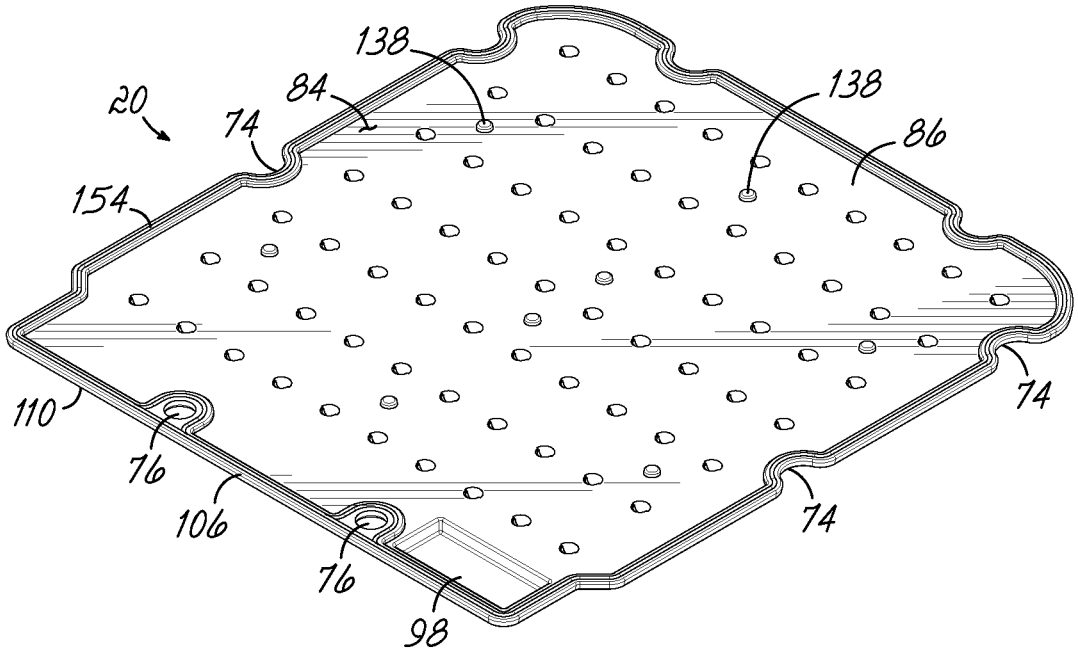
FIG. 4E is a perspective view of the reverse side of the silicone optical array shown in FIG. 4.

FIG. 4E shows the second side 94 of the silicone optical array 20 as including a sealing bead 110 formed on the silicone mat 86. The sealing bead 110 prevents air and moisture (such as water and/or humidity) from reaching the first side 96 of the substrate 16 and the array of LEDs 26. The sealing bead 110 also prevents the need for supplemental silicone gaskets, which were previously required. Removal of these supplemental silicone gaskets makes assembly of the luminaire assembly 10 easier and eliminates the costs associated with supplemental components.

FIG. 5 shows the substrate 16 as including an connector 28 which is configured to be connected to one or more power supply wires (not shown) which are routed through an air vent wireway 30. The substrate 16 includes first and second opposing sides 96, 108 and a peripheral edge 112 therebetween.

Figure 6:
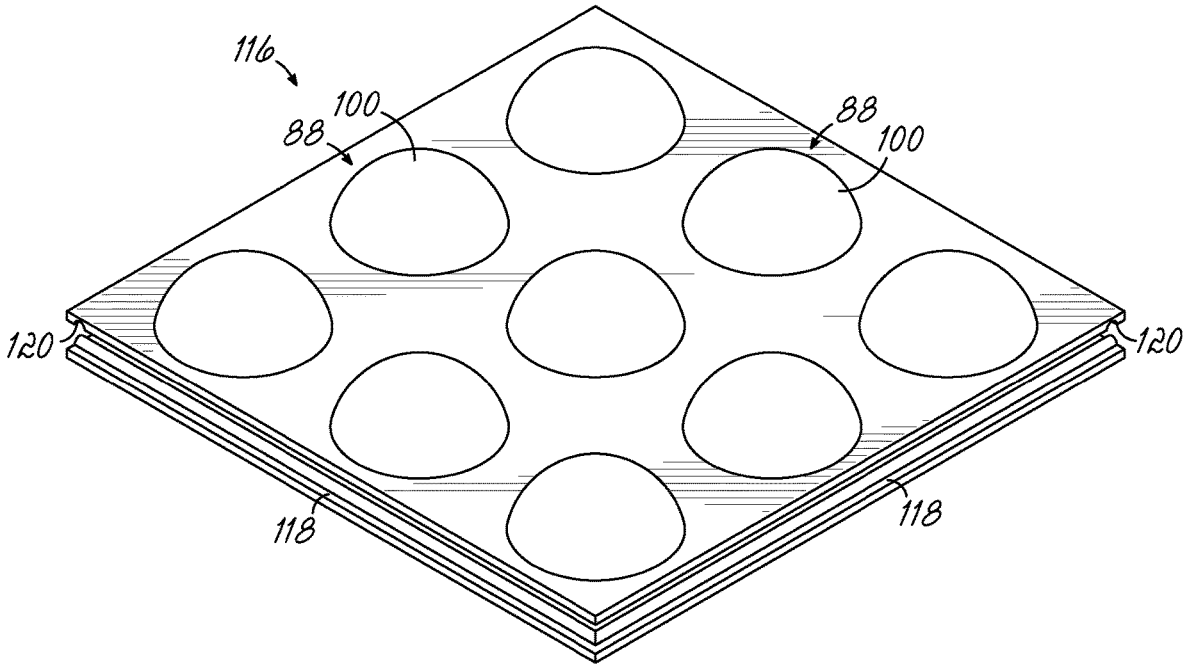
FIG. 6 is a diagrammatic perspective view of a silicone mat section according to another embodiment of the present invention.

According to one aspect of the present invention, FIG. 6 diagrammatically shows a single silicone mat section 116. As shown, the silicone mat section 116 includes a locking portion 118 located along at least two adjacent peripheral edges of the silicone mat section 116 and a receiving portion 120 located along at least the other two peripheral edges (if the silicone mat sections 116 form a rectangle). However, if the silicone mat sections 116 are intended to form a circle, this of course would change. Further, one skilled in the art would appreciate that the locking portion 118 and the receiving portion 120 may extend along only along one side or a portion of one or more sides and that different locking configurations are envisioned.

Figure 6A:
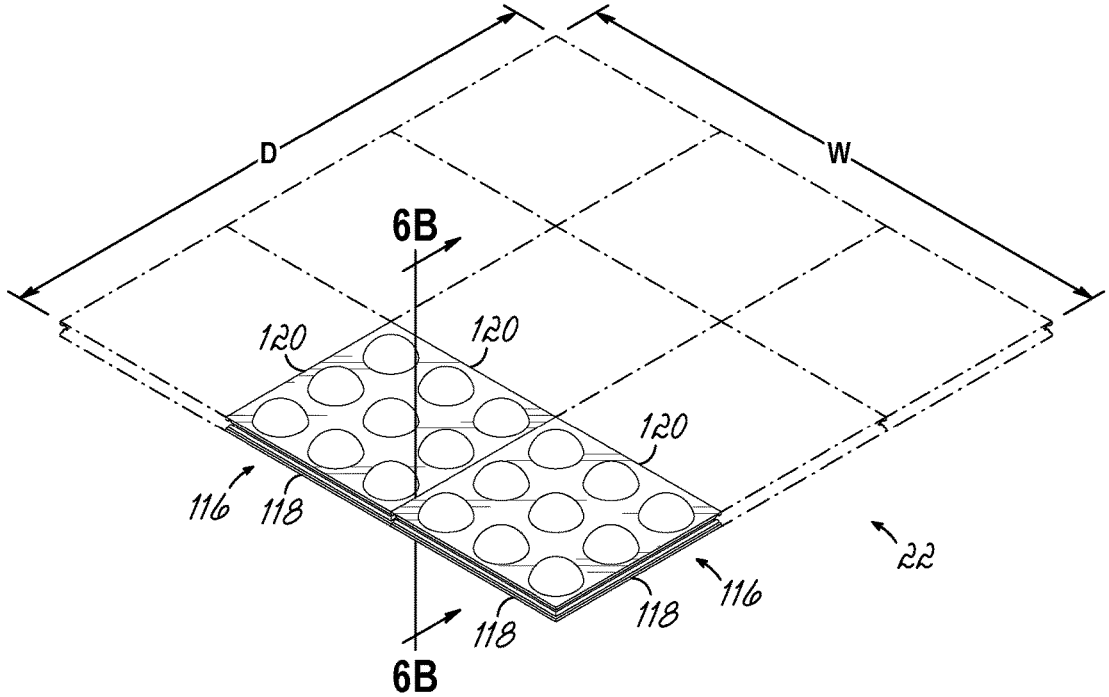
FIG. 6A is a diagrammatic perspective view of two silicone mat sections of FIG. 6 locked together to form part of a silicone optical array comprising individual silicone mat sections.

As shown in FIG. 6A, two silicone mat sections 116 are shown locked together and collectively forming part of the silicone optical array 20. Specifically, in one embodiment, the silicone optical array 20 may be formed using the width (W) of three silicone mat sections 116 and the depth (D) of three silicone mat sections 116. This configuration produces a 3×3 (W×D) array. However, more or less silicone mat sections 116 are envisioned depending on the application. For example, the multiple silicone mat sections 116 could be configured in a single row creating a long and narrow silicone optical array 20.

Figure 6B:
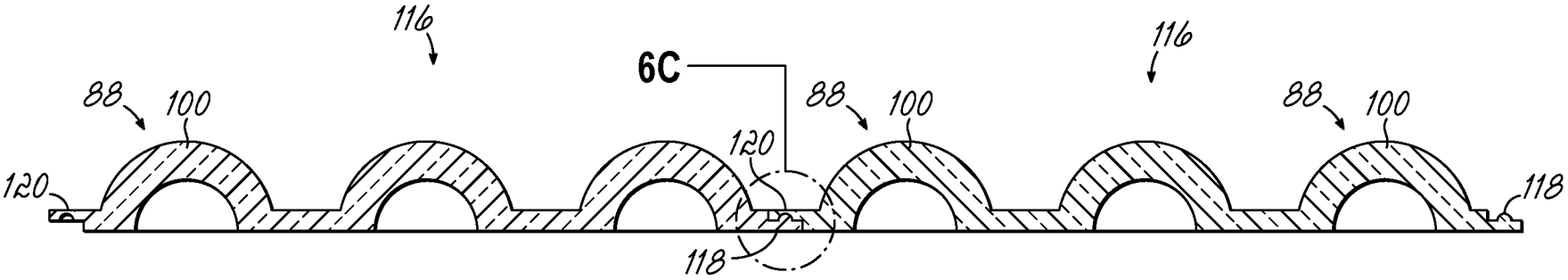
FIG. 6B is a diagrammatic cross-sectional view of the two silicone mat sections of FIG. 6A taken along line 6B-6B of FIG. 6A.
Figure 6C:
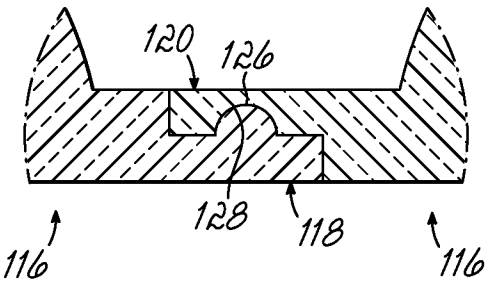
FIG. 6C is a diagrammatic enlarged detail view of the encircled area of FIG. 6B.

FIG. 6B shows a cross-sectional view of the two silicone mat sections 116 of FIG. 6A locked together, and FIG. 6C is an enlarged detail view of the encircled area of FIG. 6B showing two silicone mat sections 116 interlocked together. As shown, a locking portion 118 of a first silicone mat section 116 is coupled to a receiving portion 120 of a second silicone mat section 116. In one embodiment, the locking portion 118 includes a bead 126, while the receiving portion 120 includes a groove 128. Having the silicone mat sections 116 interlocked together allows the use of multiple silicone mat sections 116 without the need for supplemental silicone gaskets. Previously, multiple supplemental silicone gaskets and multiple circuit boards were used, which add undesirable cost and complexity.

Figure 7A:
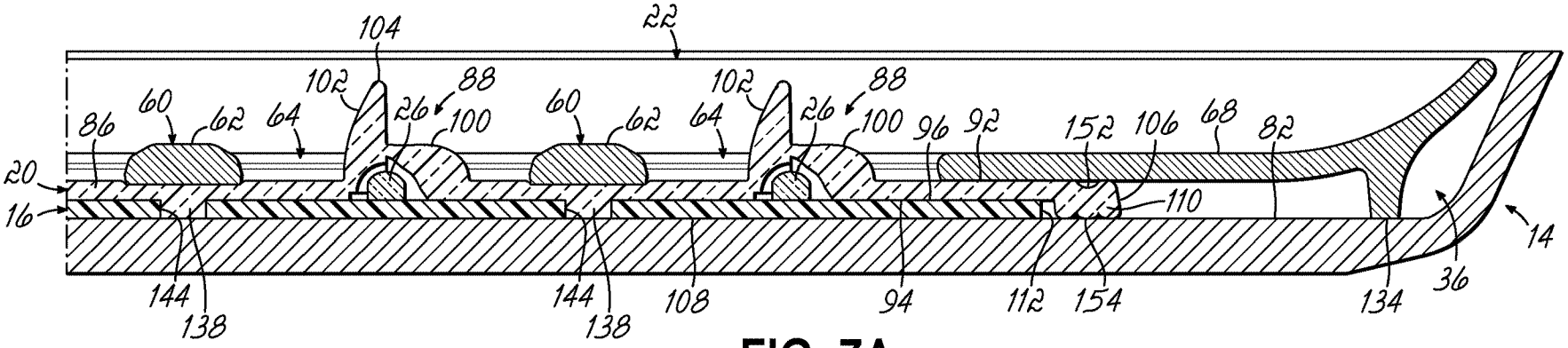
FIG. 7A is a schematic side cross-sectional view of the luminaire assembly of FIG. 7 is an assembled state.
Figure 7B:
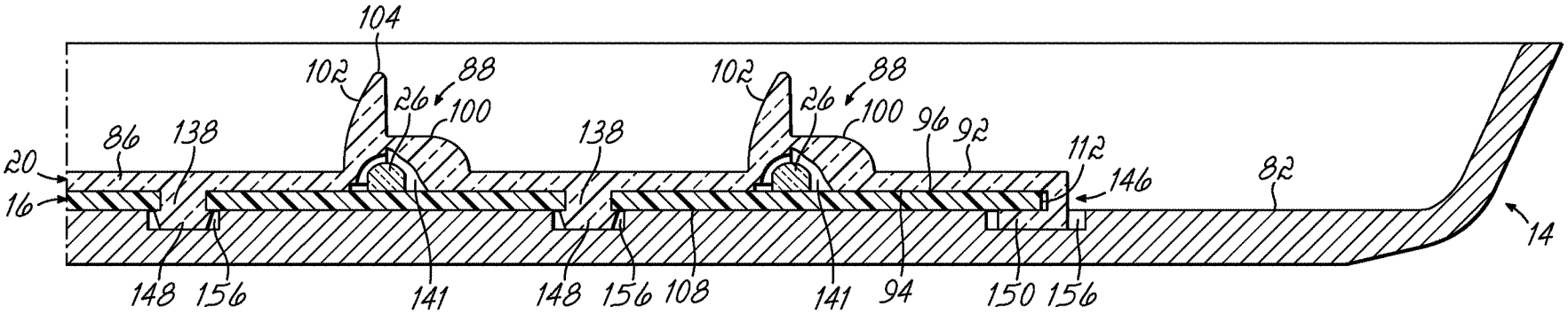
FIG. 7B is a schematic side cross-sectional view of a luminaire assembly according to another embodiment of the present invention in an assembled state.

FIGS. 7 and 7A respectively show the luminaire assembly 10 while being assembled and after being assembled. As schematically shown, the second side 108 of the substrate 16 is placed against the interior surface 82 of the light emitting chamber 36. As generally shown in FIG. 4E, and more clearly through FIG. 7, the silicone mat 86 may also include one or more silicone pegs 138 formed on the second side 94 of the silicone mat 86. Alternatively or in addition to the silicone pegs 138, with reference to FIGS. 2 and 5, the substrate 16 may include recessed cavities 132 so that the fasteners (not shown) can be countersunk and received by corresponding apertures 136 (shown in FIG. 2) in the interior surface 82 of the of the light emitting chamber 36. In this embodiment, the inner surface 122 of the silicone optic 88 includes a first surface 135 shaped as a quarter sphere located adjacent the silicone reflector 102, and second and third angled surfaces 137, 139 shaped as angled surfaces located adjacent the silicone refractor 100. As shown in FIGS. 7A and 7B, there is a void 141 located between the LEDs 26 and the silicone optics 90, which prevent the LEDs 26 from directly contacting the individual silicone optics 90, including the silicone refractor 100 and the silicone reflector 102. As shown by arrow 140 in FIG. 7, the silicone optical array 20 is then placed against the substrate 16 with the silicone pegs 138 aiding in the alignment. The silicone pegs 138 initially frictionally fit into apertures 144 extending through the substrate 16, then swell when heated to lock the silicone optical array 20 in place. The silicone pegs 138 prevent the silicone optical array 20 from shifting out of position due to shock or thermal expansion. Previously, rigid locating pins were used which did not provide as secure of a position.

As shown in FIG. 7, the sealing bead 110 includes a groove 152 located adjacent the first side 92 of the silicone optical array 20 and a bead 154 located adjacent the second side 94 of the of the silicone optical array 20. Placing the silicone optical array 20 against the substrate 16 deforms the sealing bead 110 (shown in FIG. 7A) and results in sealing between the sealing bead 110 and the interior surface 82 of the light emitting chamber 36. As shown, the groove includes two discrete contact points with the optical frame 22, while the bead includes three discrete contact points with the interior surface 82. As shown by arrow 142 in FIG. 7, the optical frame 22, including corresponding windows 64 and fingers 60 having a curved center portion 62, is then placed against the silicone optical array 20. As shown, a contact portion 134 of the optical frame 22 may contact the interior surface 82 of the light emitting chamber 36 to provide further sealing. The optical frame 22 is then fastened using fasteners 66 as described above in relation to FIG. 2.

FIG. 7B shows another embodiment of the silicone optical array 20 including undercut securing features 146, such as the silicone peg 138 including a head portion 148 or the silicone mat 86 including a wrap around portion 150. The undercut securing features 146 secure the silicone optical array 20 to the substrate 16 without the use of supplemental screws or other parts or even the optical frame 22 shown in FIGS. 7 and 7A. The silicone pegs 138 each include a head portion 148 that expands radially outward and attaches to the second side 94 of the silicone mat 86, which locks the substrate 16 to the silicone optical array 20. While FIG. 7B shows that each silicone peg 138 includes a head portion 148, it is also envisioned that only some of the silicone pegs 138 include a head portion 148. Alternately or in addition to the silicone pegs 138 having a head portion 148, the silicone mat 86 may include a wrap around portion 150 that is configured to wrap around the peripheral edge 112 of the substrate 16. As shown, the wrap around portion 150 contacts the first and second opposing sides 96, 108 of the substrate 16, while not contacting the peripheral edge 112 of the substrate 16. However, if desired, the wrap around portion 150 may contact the peripheral edge 112 of the substrate 16 in addition to the first and second opposing sides 96, 108 of the substrate 16. The housing also includes recessed portions 156 that account for the thickness of the undercut securing features 146. The recessed portions 156 allow the second side 108 of the substrate 16 to contact the interior surface 82 of the light emitting chamber 36.

In one exemplary embodiment, the silicone optical array 20 (including the silicone mat 86, the silicone refractor 100, the silicone reflector 102, and the silicone pegs 138) is constructed from optical grade silicone using an injection molding process, and advantageously forms a single unitary component. In one embodiment, the silicone optical array 20 is formed using a silicone material, such as MS-1002 Moldable Silicone or other silicone materials in the MS-Series that are commercially available from Dow Corning located in Auburn, Mich. Of course, other suitable silicone materials are possible as well. Previously, an optical array was constructed using stiff polymeric materials, such as polycarbonate and acrylic. However, new optical grade silicone allows for improved optical control. The use of optical grade silicone for the silicone optical array 20 presents many advantages over other previously used materials. These advantages include high photo-thermal stability resulting in low yellowing at operating temperatures and high lumen density, ultraviolet resistance allowing for reliability overtime for outdoor applications, high transmittance, thermal and moisture resistance. Further, optical grade silicone is lighter than glass, enables accurate reproducibility of detailed shapes, allows integration of additional functionalities such as gaskets, allows optical designs with large differences in wall-thickness, and provides ease of processing enabling a lower total cost of ownership.

The LEDs of this exemplary embodiment can be of any kind, color (e.g., emitting any color or white light or mixture of colors and white light as the intended lighting arrangement requires) and luminance capacity or intensity, preferably in the visible spectrum. Color selection can be made as the intended lighting arrangement requires. In accordance with the present disclosure, LEDs can comprise any semiconductor configuration and material or combination (alloy) that produce the intended array of color or colors. The LEDs can have a refractive optic built-in with the LED or placed over the LED, or no refractive optic; and can alternatively, or also, have a surrounding reflector, e.g., that re-directs low-angle and mid-angle LED light outwardly. In one suitable embodiment, the LEDs are white LEDs each comprising a gallium nitride (GaN)-based light emitting semiconductor device coupled to a coating containing one or more phosphors. The GaN-based semiconductor device can emit light in the blue and/or ultraviolet range, and excites the phosphor coating to produce longer wavelength light. The combined light output can approximate a white light output. For example, a GaN-based semiconductor device generating blue light can be combined with a yellow phosphor to produce white light. Alternatively, a GaN-based semiconductor device generating ultraviolet light can be combined with red, green, and blue phosphors in a ratio and arrangement that produces white light (or another desired color). In yet another suitable embodiment, colored LEDs are used, such are phosphide-based semiconductor devices emitting red or green light, in which case the LED assembly produces light of the corresponding color. In still yet another suitable embodiment, the LED light board may include red, green, and blue LEDs distributed on the printed circuit board in a selected pattern to produce light of a selected color using a red-green-blue (RGB) color composition arrangement. In this latter exemplary embodiment, the LED light board can be configured to emit a selectable color by selective operation of the red, green, and blue LEDs at selected optical intensities. Clusters of different kinds and colors of LED is also contemplated to obtain the benefits of blending their output.

While the present invention has been illustrated by description of various embodiments and while those embodiments have been described in considerable detail, it is not the intention of applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of applicant's invention.

What is claimed is:

1. A silicone optical array for use with a luminaire assembly having an optical frame coupled to a housing having a light emitting chamber, and a substrate including a first side, and an opposite second side, and a plurality of light emitting sources arranged in an array on the first side of the substrate and mounted within the light emitting chamber of the housing, the silicone optical array comprising:

a silicone mat configured to be positioned entirely within the light emitting chamber of the housing and between the optical frame and the housing;

a plurality of silicone optics formed in the silicone mat and being arranged in an array corresponding to the array of light emitting sources; and a continuous sealing bead integrally formed on the silicone mat adjacent at least one peripheral edge thereof and being configured to engage and seal with an inner surface of the light emitting chamber of the housing about a periphery of the substrate, the sealing bead extending the entire length of the peripheral edge of the substrate with the substrate being located between the silicone mat and the housing such that the first side of the substrate is adjacent to the silicone mat and the second side of the substrate is adjacent to the housing;

wherein the optical frame is configured to maintain the seal between the continuous sealing bead and the inner surface of the light emitting chamber of the housing as a result of the optical frame being coupled to the housing and in contact with the silicone mat.

2. The silicone optical array of claim 1, wherein each silicone optic comprises:

a refractor formed in the silicone mat.

3. The silicone optical array of claim 1, wherein each silicone optic comprises:

a silicone refractor and a silicone reflector integrally formed with the silicone mat.

4. The silicone optical array of claim 1, further comprising:

one or more silicone pegs formed on an underside of the silicone mat and being configured to secure the silicone mat to a substrate supporting the array of light emitting sources.

5. The silicone optical array of claim 4, wherein at least one of the silicone pegs has a head portion configured to contact an underside of the substrate supporting the array of light emitting sources.

6. The silicone optical array of claim 1, wherein the silicone mat comprises:

at least first and second silicone mat sections interlocked together, wherein one of the first or second silicone mat sections has a locking portion that is configured to couple with a receiving portion of the other of the first or second silicone mat sections by overlapping one of the locking portion or the receiving portion over the other.

7. The silicone optical array of claim 6, wherein the locking portion and the receiving portion are provided adjacent at least one peripheral edge of the respective first or second silicone mat sections.

8. The silicone optical array of claim 6, wherein the locking portion is integrally formed with one of the first or second silicone mat sections, and the receiving portion is integrally formed with the other of the first or second silicone mat sections.

9. A silicone optical array for use with a luminaire assembly having a plurality of light emitting sources arranged in an array, the silicone optical array comprising:

a silicone mat comprising at least first and second silicone mat sections interlocked together, the at least first and second silicone mat sections including a first side and an opposite second side, wherein one of the first or second silicone mat sections has an elongated locking portion extending along at least one entire edge thereof that is configured to couple with an elongated receiving portion extending along at least one entire opposing edge of the other of the first or second silicone mat sections by overlapping one of the locking portion or the receiving portion over the other in a vertical direction; and a plurality of silicone optics formed on the first side of the silicone mat and being arranged in an array corresponding to the array of light emitting sources;

wherein the second side of the receiving portion of one of the first or second silicone mat sections forms a continuous and coplanar extension of the second side of the other of the first or second silicone mat sections.

10. A luminaire assembly comprising:

a housing defining a light emitting chamber, the housing having an electrical component chamber separated by a wall from the light emitting chamber, and an air vent wireway extending through the wall and fluidly communicating with the light emitting chamber and the electrical component chamber, the air vent wireway being configured to prevent an accumulation of air pressure in the light emitting chamber;

a substrate having a plurality of light emitting sources located on a first side of the substrate being supported by the substrate in an array, the substrate defining a peripheral edge;

a connector mounted on the first side of the substrate and being electrically coupled to the plurality of light emitting sources; and a silicone optical array having a plurality of silicone optics formed in the silicone optical array, the silicone optical array being located so as to cover at least the first side of the substrate and the plurality of light emitting sources, the silicone optical array comprising a silicone mat with the plurality of optics formed in the mat in an array corresponding to the array of light emitting sources;

wherein the silicone optical array further comprises a raised portion configured to receive therein a portion of the connector.

11. The luminaire assembly of claim 10, wherein each silicone optic comprises:

a refractor formed in the silicone mat.

12. The luminaire assembly of claim 10, wherein each silicone optic comprises:

a silicone refractor and a silicone reflector integrally formed with the silicone mat.

13. The luminaire assembly of claim 12, wherein at least one of the reflectors is shaped as a disc that is angled toward the refractor at a top portion to maximize the efficiency of at least one of the plurality of light emitting sources.

14. The luminaire assembly of claim 10, wherein the silicone optical array further comprises:

one or more silicone pegs formed on an underside of the silicone mat and being configured secure the silicone mat to a substrate supporting the array of light emitting sources.

15. The luminaire assembly of claim 10, wherein at least one of the silicone pegs has a head portion configured to contact an underside of the substrate supporting the array of light emitting sources.

16. The luminaire assembly of claim 10, further comprising:

an optical frame including plurality of fingers for securing the silicone optical array against the substrate, the optical frame further comprising a plurality of windows located respectively between the plurality of fingers that are configured to allow light emitted from the light emitting sources to emanate therethrough.

17. The luminaire assembly of claim 16, wherein the plurality of fingers extend generally parallel one another from a peripheral edge to an opposite peripheral edge of the optical frame.

18. The luminaire assembly of claim 16, wherein the plurality of fingers have a curved center portion that curves inwardly toward, and is in direct contact with, the silicone optical array, and wherein the curved center portion provides a clamping force to secure a center region of the silicone optical array to the optical frame.

19. The luminaire assembly of claim 10, wherein the silicone optical array is configured to wrap around the peripheral edge of the substrate and contact opposing sides of the substrate.

20. A silicone optical array for use with a luminaire assembly having a housing, a substrate including a first side and an opposite second side, and a plurality of light emitting sources arranged in an array, the silicone optical array comprising:

a silicone mat having a first side and an opposite second side;

a plurality of silicone optics formed on the first side of the silicone mat and being arranged in an array corresponding to the array of light emitting sources;

one or more silicone pegs formed on the second side of the silicone mat and being configured to extend entirely through the substrate supporting the array of light emitting sources and secure the silicone mat to the substrate such that the second side of the silicone mat directly engages and covers the first side of the substrate; and one or more wrap around portions integrally formed on the silicone mat adjacent at least one peripheral edge thereof and being configured to contact the second side of the substrate;

wherein one or more recesses formed in the housing of the luminaire assembly are configured to receive the one or more wrap around portions.

21. The silicone optical array of claim 20, wherein at least one of the silicone pegs has a head portion configured to contact an underside of the substrate supporting the array of light emitting sources.

* * * * *